US007265495B2

(12) United States Patent
Date

(10) Patent No.: US 7,265,495 B2
(45) Date of Patent: Sep. 4, 2007

(54) DISPLAY DRIVER

(75) Inventor: Yoshito Date, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 158 days.

(21) Appl. No.: 11/124,265

(22) Filed: May 9, 2005

(65) Prior Publication Data

US 2005/0200583 A1 Sep. 15, 2005

Related U.S. Application Data

(63) Continuation of application No. 10/727,052, filed on Dec. 4, 2003, now Pat. No. 6,924,601.

(30) Foreign Application Priority Data

Dec. 19, 2002 (JP) ..... 2002-367857

(51) Int. Cl.
*G09G 3/10* (2006.01)

(52) U.S. Cl. ..... 315/169.1; 315/169.3; 345/90; 345/98; 345/214; 327/108; 327/132

(58) Field of Classification Search ..... 315/169.1, 315/169.3; 345/76, 77, 84, 90, 98, 211, 214; 341/135, 136, 144; 327/108, 109, 111, 127, 327/132, 427

See application file for complete search history.

(56) References Cited

U.S. PATENT DOCUMENTS 5,633,653 A * 5/1997 Atherton ..... 345/98
5,696,459 A * 12/1997 Neugebauer et al. ..... 327/108
6,054,880 A * 4/2000 Barou ..... 327/109
6,147,665 A 11/2000 Fridman
6,421,034 B1 7/2002 Mihara
6,456,270 B1 * 9/2002 Itakura ..... 345/98
6,509,854 B1 1/2003 Morita et al.
6,586,888 B2 7/2003 Kitahara et al.
6,646,481 B2 11/2003 Blankenship et al.
6,717,604 B2 * 4/2004 Nagumo ..... 347/237
6,765,560 B1 7/2004 Ozawa
6,777,885 B2 * 8/2004 Koyama ..... 315/169.1
6,882,186 B2 4/2005 Nishitoba
6,897,619 B2 5/2005 Shimizu
6,958,742 B2 * 10/2005 Date et al. ..... 345/90
2002/0145584 A1 10/2002 Waterman
2003/0067345 A1 4/2003 Blankenship et al.

(Continued)

FOREIGN PATENT DOCUMENTS

JP 62-262517 11/1987

(Continued)

*Primary Examiner*—Haissa Philogene
(74) *Attorney, Agent, or Firm*—McDermott Will & Emery LLP

(57) ABSTRACT

A display driver comprises second and third MOSFETs for supplying reference currents equal to each other, a first current-input MOSET connected to the second MOSFET, a second current-input MOSFET connected to the third MOSFET, a plurality of mirroring devices which are placed between the first current-input MOSFET and the second current-input MOSFET and to which a current fed to each of the first and second current-input MOSFETs is distributed, and current adding means for changing the output current value by adding currents produced in the plurality of mirroring devices.

55 Claims, 7 Drawing Sheets

U.S. PATENT DOCUMENTS

| | | | |
|---|---|---|---|
| 2003/0151567 | A1 | 8/2003 | Hanada et al. |
| 2003/0184568 | A1 | 10/2003 | Dote et al. |

FOREIGN PATENT DOCUMENTS

| | | | |
|---|---|---|---|
| JP | 5-216439 | | 8/1993 |
| JP | 9-319323 | | 12/1997 |
| JP | 11-205147 | | 7/1999 |
| JP | 11-340765 | | 12/1999 |
| JP | 2000-310981 | | 11/2000 |
| JP | P2001-67048 | A | 3/2001 |
| JP | P2001-147659 | A | 5/2001 |
| JP | P2001-168697 | A | 6/2001 |
| JP | 2002-202823 | | 7/2002 |
| JP | 2003-255898 | | 9/2003 |

* cited by examiner

DISPLAY DRIVER

The present invention is a continuation of U.S. patent application Ser. No. 10/727,052, filed on Dec. 4, 2003, (U.S. Pat. No. 6,924,601) and the contents of which are hereby incorporated by reference. This application also includes subject matter relating to U.S. patent application Ser. No. 10/797,245, filed Mar. 11, 2004 and U.S. patent application No. 10/815,800 filed Apr. 2, 2004.

BACKGROUND OF THE INVENTION (1) Technical Field

The present invention relates to a display driver LSI for driving a display such as a liquid crystal panel, and more particularly to a circuit arrangement for supplying a uniform current to each of the display drivers.

(2) Background Art

In recent years, Flat Panel Displays (FPDs) have been becoming thinner and lighter and costing less with increased screen size and fineness. Against this backdrop, display driver LSIs for driving a display panel such as an FPD are being improved.

FIG. 7A is a diagram schematically showing the structure of a display panel part of a liquid crystal display, FIG. 7B is a circuit diagram showing the structure of a known display driver, and FIG. 7C is a view showing variations in brightness of the display panel. These drawings show an example of a liquid crystal display panel in which gray scale control is performed in accordance with the magnitude of voltage.

As shown in FIGS. 7A and 7B, in a typical TFT (Thin Film Transistor) active liquid crystal display panel, pixels (sub-pixels) 601 each composed of a transparent TFT 602 and a liquid crystal capacitance 603 connected to the TFT 602 are placed in matrix. Each of the pixels 601 is connected to a corresponding drive voltage supply unit located in a display driver LSI 605 and supplied with a voltage for gray-scale control from the display driver LSI 605. The display driver LSI 605 is obtained by integrating, on a single chip, not only a bias current circuit 606 but also plural drive voltage supply units, such as drive voltage supply units 619, 620 and 621. In the case of a large-screen liquid crystal display, a plurality of display driver LSIs 605 of this kind are placed in the frame of the display panel. A circuit including a bias current circuit (current source) and a drive voltage supply unit is herein referred to as a "display driver".

In this display panel, the level at which display pixels shield backlight varies by changing the voltage value to be applied to the liquid crystal capacitance 603. This leads to a change in display brightness in proportion to the voltage applied from the display driver.

Next, a description will be given of the structure of the known display driver LSI shown in FIG. 7B.

First, a bias current circuit 606 for supplying a current of a fixed value to a drive voltage supply unit 619 includes a first metal oxide semiconductor field-effect transistor (MOSFET) 608 of a first conductive type, a resistor 607 connected to the first MOSFET 608, a second MOSFET 609 constituting a current mirror in conjunction with the first MOSFET 608, and an input transistor 610 of a second conductive type connected to the second MOSFET 609. The input transistor 610 is for inputting current to a current mirroring part located in the drive voltage supply unit 619 that will be described later.

Next, the drive voltage supply unit 619 includes a current addition type digital/analog (D/A) converter 630 having plural current mirroring devices, and a current/voltage converter 611 connected to the output part of the D/A converter 630.

The D/A converter 630 includes a first mirroring device $CM_1$, a second mirroring device $CM_2$, . . . , and an n-th mirroring device $CM_n$ each composed of a MOSFET of a second conductive type (in this case, N-channel type) and constituting a current mirror in conjunction with the input transistor 610, and switches $L_1$, $L_2$, . . . , and $L_n$ connected to the first mirroring device $CM_1$, the second mirroring device $CM_2$, . . . , and the n-th mirroring device $CM_n$, respectively (n: natural number). The current/voltage converter 611 consists of an operational amplifier subjected to negative feedback and a resistor. Each of drive voltage supply units 620 and 621 also has the same structure as the drive voltage supply unit 619, and gate electrodes of the mirroring devices of plural drive voltage supply units are connected together via a common conductor.

Next, a description will be given of current flowing through the known display driver.

The bias current circuit 606 of the known display driver can produce a desired magnitude of reference current by controlling the resistance value of the resistor 607. This reference current is distributed to the second MOSFET 609 and then is fed to the input transistor 610. At this time, a current flows through each of a first mirroring device $CM_1$, a second mirroring device $CM_2$, . . . , and an n-th mirroring device $CM_n$. FIG. 7B simply shows the mirroring devices as if each of them is composed of a single transistor. However, they are actually composed of one, two, four, . . . , and $2^{n-1}$ transistors of an equal size, respectively. For example, in the case of a 6-bit (64-gray-level) liquid crystal display, 1+2+4+8+16+32=63 transistors are provided in accordance with the weighting of bits. Therefore, in the case where a current flowing through a switch $L_1$ in on position is assumed as I, currents flowing through the switches $L_2$, $L_3$, . . . , $L_n$ when the switches $L_2$, $L_3$, . . . , $L_n$ are on are 2I, 4I, . . . , $2^{n-1}$, respectively. Hence, when the on/off switching of each of the switches $L_1$, $L_2$, . . . , $L_n$ is controlled, it becomes possible to feed $2^n$ different levels of current to the current/voltage converter 611. The current/voltage converter 611 converts the fed current into voltage and supplies the resultant voltage to the pixel 601.

Next, a description will be briefly given of the operation of the known display driver.

In the known display driver, display data are held in the form of digital signals (not shown). The switches $L_1$, $L_2$, . . . , $L_n$ are turned on or off depending on these display data. When all of the display data are displayed in white, all of the switches $L_1$ through $L_n$ are turned on. On the other hand, when all of the display data are displayed in black, all of the switches $L_1$ through $L_n$ are turned off.

SUMMARY OF THE INVENTION

The above-mentioned known display driver can drive a small-screen display panel, such as a display panel of a cellular phone, without problems.

However, display panel screens have further been increased in size, and display driver LSIs with a length (longitudinal dimension) reaching 10 mm through 20 mm have now come out. In these cases, the known display driver LSI may cause variations in output voltage among output terminals that are separate from each other, whereby there is the possibility that image degradation is caused, for example, light and dark parts are produced on a display image.

The present inventor's study on the reason for variations in output voltage among the output terminals of the display driver LSI has shown that a variety of currents are fed to the current mirrors of the display drivers. A current mirror circuit is primarily premised on that constituent transistors have equal diffusion conditions and have no significant difference in threshold value Vt and carrier mobility. Based on this premise, a current is distributed to mirroring transistors in accordance with the size ratio among the transistors. However, it is considered that when the chip of the display driver LSI is as long as 10 mm through 20 mm, it becomes difficult to uniformly diffuse impurities to be included in the transistors over the entire LSI. As a result, the threshold values vary among the transistors constituting a current mirror, leading to variations in output voltage. Usually, diffusion varies to have a gradual inclination with respect to a wafer surface. Thus, even when certain display data are uniformly displayed, a gradation from light to dark will be caused on the display panel as shown in FIG. 7C.

It is an object of the present invention to provide means for suppressing variations among the outputs of the display driver LSIs.

A display driver of the present invention comprises: a first reference current source and a second reference current source both for supplying a reference current; a first current-input transistor of a first conductive type including a control portion, a second impurity diffusion layer and a first impurity diffusion layer connected to the first reference current source; a second current-input transistor of the first conductive type including a control portion, a second impurity diffusion layer and a first impurity diffusion layer connected to the second reference current source; a plurality of mirroring devices to which currents fed to the first current-input transistor and the second current-input transistor are distributed and which are composed of transistors of the first conductive type including control portions connected to one another; and current adding means connected to the plurality of mirroring devices for changing the output current by adding currents produced in mirroring devices selected from among the plurality of mirroring devices in accordance with display data, wherein the display driver is integrated on a chip.

With this structure, currents are distributed from at least two reference current sources to a plurality of mirroring devices. Therefore, variations in diffusion of impurities or the like can compensate for variations in threshold values (or current driving forces) of transistors constituting a current mirror. Hence, currents delivered from the mirroring devices can become uniform. Thus, even for a large-screen, current-driven display, variations in brightness can be suppressed. Furthermore, a large-screen liquid crystal display having improved display quality can be realized by adding a current/voltage converting circuit.

The plurality of mirroring devices may be placed between the first current-input transistor and the second current-input transistor. In this case, a potential gradient can be caused between the control portion of the first current-input transistor and the control portion of the second current-input transistor. This allows variations in the threshold values of the transistors constituting a current mirror to be more effectively compensated for. As a result, variations in currents produced in the mirroring devices can be further suppressed, thereby further improving the display quality of the display.

The display driver may further comprise: a first transistor of a second conductive type which is supplied at one end with a supply voltage and connected at the other end to a resistor, thereby producing a current of a predetermined value, wherein the first reference current source and the second reference current source are equal in size ratio to each other and are transistors constituting a current mirror circuit in conjunction with the first transistor. Thus, the first and second reference current sources for supplying currents equal to each other can be realized with a simple structure by utilizing the current mirror circuit.

The first reference current source and the second reference current source may be placed 100 μm or less apart from each other, and the length and width of a wire via which the first reference current source is connected to the first current-input transistor may be substantially the same as those of a wire via which the second reference current source is connected to the second current-input transistor. Thus, the error between a current flowing through the first current-input transistor and a current flowing through the second current-input transistor can be minimized.

Resistor elements each having an equal resistance value are further provided between the control portion of one of the plurality of mirroring devices adjacent to the first current-input transistor and the control portion of the first current-input transistor, between the control portions of each two of the plurality of mirroring devices adjacent to each other, and between the control portion of one of the plurality of mirroring devices adjacent to the second current-input transistor and the control portion of the second current-input transistor, respectively. Thus, even when a sufficient potential gradient cannot be formed between the control portion of the first current-input transistor and the control portion of the second current-input transistor, a potential gradient can be obtained utilizing a drop in voltage caused by the resistor elements. As a result, variations in currents produced in the plurality of mirroring devices can be further suppressed.

The display driver may further comprise: a third reference current source that is placed between the first reference current source and the second reference current source, constitutes a current mirror circuit in conjunction with the first transistor and is composed of a transistor equal in size ratio to each of the first reference current source and the second reference current source; and a third current-input transistor of the first conductive type that is connected to the third reference current source, is placed in the approximately central portion between the first current-input transistor and the second current-input transistor and constitutes a current mirror circuit in conjunction with the plurality of mirroring devices. Thus, variations in currents produced in the plurality of mirroring devices can be further suppressed.

A fourth reference current source constituting a current mirror in conjunction with the first transistor and composed of a transistor equal in size ratio to each of the first reference current source and the second reference current source, and a current-transfer terminal connected to the fourth reference current source may be further provided on the same chip as the first transistor, and a resistor connected to the first transistor may be provided on the same chip as the first transistor. Thus, this display driver can be employed as a display driver in the first stage when plural display drivers are connected to one another. That is, since the reference current produced in the fourth reference current source can be transferred via the current-transfer terminal to a display driver in the next stage, currents delivered from the mirroring devices can be equalized even when the characteristics of the mirroring devices vary among the chips.

A first current-input/output terminal for transferring a reference current, a second transistor of the first conductive type including a second impurity diffusion layer, and a first impurity diffusion layer and a control portion both connected to the first current-input/output terminal, and a third transistor of the first conductive type including a second impurity diffusion layer, a control portion, and a first impurity diffusion layer connected to the first impurity diffusion layer of the first transistor and constituting a current mirror circuit in conjunction with the second transistor may be further provided on the same chip as the first transistor. Thus, when plural display drivers are connected to one another, this display driver can be employed as a display driver in the second and later stages.

A fourth transistor of the first conductive type cascode-connected to the second impurity diffusion layer of the second transistor and a fifth transistor of the first conductive type constituting a current mirror circuit in conjunction with the fourth transistor may be further provided on the same chip as the first transistor. Thus, when plural display drivers are connected to one another, this display driver can be employed as a display driver in the second and later stages. In addition, variations in reference currents transferred from a display driver in the previous stage can be minimized by a current mirror composed of cascode-connected transistors.

A second current-input/output terminal connected to the first impurity diffusion layer of the first transistor and the first impurity diffusion layer of the third transistor, a fourth reference current source composed of a transistor that constitutes a current mirror in conjunction with the first transistor and is equal in size ratio to each of the first reference current source and the second reference current source, and a current-transfer terminal connected to the fourth reference current source may be further provided on the same chip as the first transistor. Thus, cascade connection of only one kind of chips realizes a structure in which a common reference current can be distributed to each of plural display drivers. Hence, when this display driver is employed, a display panel having improved display quality can be provided at lower cost.

The first reference current source, the second reference current source, the first current-input transistor, the second current-input transistor, and the plurality of mirroring devices may be MOSFETs having a first impurity diffusion layer serving as a drain, a second impurity diffusion layer serving as a source and a control portion serving as a gate electrode.

DETAILED DESCRIPTION OF THE INVENTION

Embodiments of the present invention will be described hereinafter with reference to the drawings.

(Embodiment 1)

Figure 1:
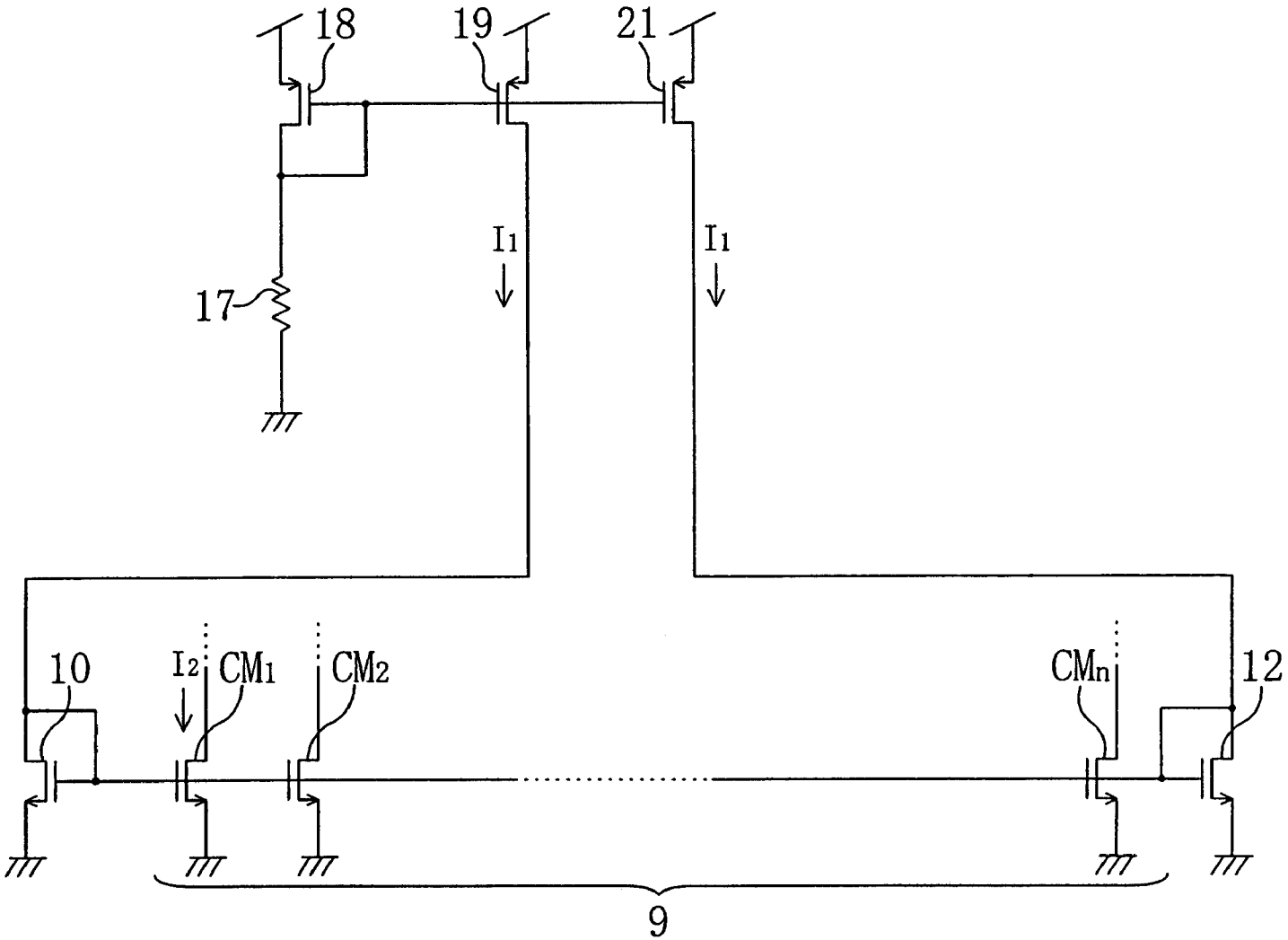
FIG. 1 is a circuit diagram showing a display driver according to a first embodiment of the present invention.
Figure 2:
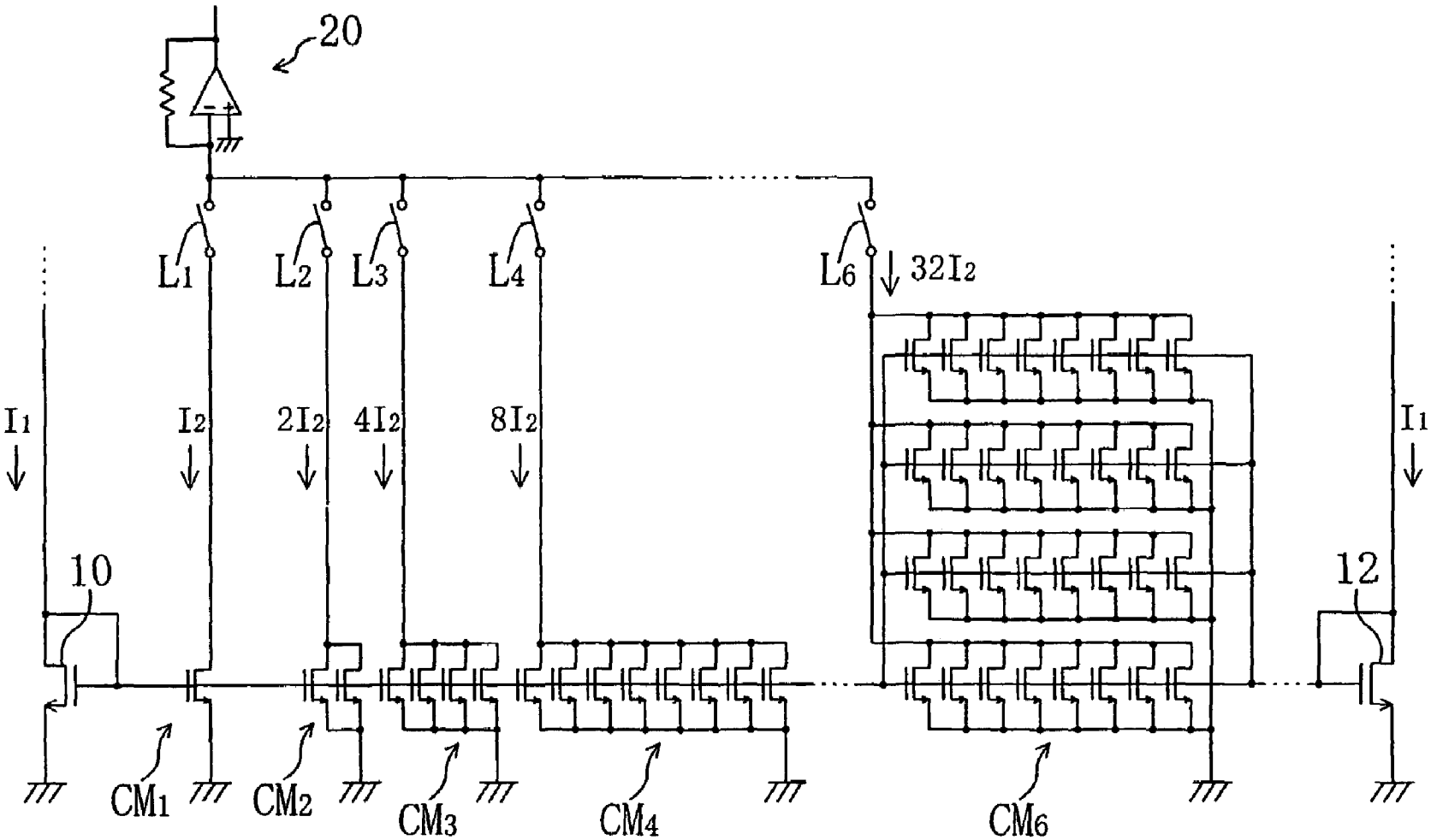
FIG. 2 is a circuit diagram showing a drive voltage supply unit for 64 gray levels in the display driver according to the first embodiment.

FIG. 1 is a circuit diagram showing a display driver according to a first embodiment of the present invention. FIG. 2 is a circuit diagram showing a drive voltage supply unit for 64 gray levels in the display driver according to this embodiment. The display driver of this embodiment is preferably used for driving a voltage-driven display, in particular, a liquid crystal display.

As shown in FIG. 1, a display driver of this embodiment is characterized in that it includes at least two current sources for producing a reference current $I_1$ utilizing a current mirror circuit. The structure of the display driver will be described hereinafter.

As shown in FIGS. 1 and 2, the display driver of this embodiment includes a bias current circuit for supplying a current of a fixed value to the drive voltage supply unit.

This bias current circuit includes a first MOSFET 18 of a first conductive type, a resistor 17 connected to the first MOSFET 18, a second MOSFET 19 and a third MOSFET 21 each constituting a current mirror in conjunction with the first MOSFET 18, a first current-input MOSFET 10 for inputting a current, which is of a second conductive type and is connected to the second MOSFET 19, and a second current-input MOSFET 12 for inputting a current, which is of a second conductive type and is connected to the third MOSFET 21. The gate electrode of the first current-input MOSFET 10 is electrically connected to the gate electrode of the second current-input MOSFET 12. The above resistor 17 may be provided inside the chip or may be provided outside.

Concerning MOSFETs constituting a current mirror, FIGS. 1 and 2 show an example in which the first conductive type is an N-channel type and the second conductive type is a P-channel type. However, the first conductive type may be a P-channel type and the second conductive type may be an N-channel type. This is common to the following embodiments.

Although schematically shown in FIG. 1, a group 9 of mirroring devices constituting a current mirror in conjunction with the first current-input MOSFET 10 and the second current-input MOSFET 12 is provided between the first current-input MOSFET 10 and the second current-input MOSFET 12. The mirroring device group 9 is a part of the drive voltage supply unit and is composed of a first mirroring device $CM_1$, a second mirroring device $CM_2$, . . . , and an n-th mirroring device $CM_n$ each formed of a MOSFET of a second conductive type. The second MOSFET 19 and the third MOSFET 21 are preferably placed in the vicinity of each other for the purpose of suppressing variations in their characteristics. It is preferable that the distance between the second MOSFET 19 and the third MOSFET 21 is usually between 10 μm and 100 μm both inclusive.

On the other hand, as shown in FIG. 2, the drive voltage supply unit has the same structure as the known one and includes a current addition type D/A converter that is composed of the mirroring device group 9 and switches $L_1$ through $L_n$ (current adding means) connected to the corresponding mirroring devices, and a current/voltage converter 20 connected to the output part of the D/A converter and consisting of an operational amplifier and a resistor. In this embodiment, FIG. 1 simply shows the first mirroring device $CM_1$, the second mirroring device $CM_2$, . . . , and the n-th mirroring device $CM_n$ as if each of them is composed of a single MOSFET. However, they are actually composed of one, two, four, . . . , and $2^{n-1}$ sets of MOSFETs, respectively, whose gates are connected together via a common conductor and each of which has an equal size ratio (width/length (W/L) ratio).

Although FIG. 2 shows only the current mirror of one drive voltage supply unit placed between the first current-input MOSFET 10 and the second current-input MOSFET 12, current mirrors of plural drive voltage supply units placed on a single chip are actually put between the first current-input MOSFET 10 and the second current-input MOSFET 12.

Next, current flowing through the display driver including current sources will be described.

First, the bias current circuit is provided with a resistor 17, whereby a current of a predetermined value flows through the first MOSFET 18. At this time, this current is distributed to each of the second MOSFET 19 and the third MOSFET 21, and reference currents $I_1$ each having an approximately equal magnitude simultaneously flow through them.

Next, the reference currents $I_1$ are fed to the drains of the first current-input MOSFET 10 and the second current-input MOSFET 12. At this time, when the switches $L_1$, $L_2$, . . . , and $L_n$ are in an on state, a current $I_2$ flows through each of the MOSFETs constituting the mirroring device group 9. That is, in the example shown in FIG. 2, currents $I_2$, $2I_2$, . . . , and $2^{n-1}I_2$ flow through the switches $L_1$, $L_2$, . . . , and $L_n$ that are in an on state, respectively. Hence, when the on/off switching of each of the switches $L_1$, $L_2$, . . . , and $L_n$ is controlled, it becomes possible to feed $2^n$ different levels of current to the current/voltage converter 20. In other words, each of the switches $L_1$ through $L_n$ serves as a current adding means for varying the output current value by adding currents produced in the mirroring devices.

Then, the current/voltage converter 20 converts the fed current into voltage to supply the resultant voltage to a pixel of, for example, a liquid crystal display.

In the display driver of this embodiment, for example, the reference current $I_1$ is 630 nA, and the current $I_2$ is 10 nA. They are set as $I_1$:$I_2$=63:1. The reason why the reference current $I_1$ is set larger than the current $I_2$ in this manner is that when the resistor 17 is provided outside a chip, its resistance value is to become small. The resistance value of the resistor 17 is, for example, approximately 1 MO, but it is undesirable that the resistance value is excessively large, because in this case, the resistor 17 is susceptible to the external environment. When the first MOSFET 18 has a different size ratio from the second and third MOSFETs 19 and 21, the value of the current produced by the first MOSFET 18 will be different from the value of the reference current $I_1$.

In the display driver of this embodiment, display data are held in the form of digital signals (not shown). Each of the switches $L_1$, $L_2$, . . . , and $L_n$ is turned on or off depending on these display data. When all of the display data are displayed in white, all of the switches $L_1$ through $L_n$ are turned on. On the other hand, when all of the display data are displayed in black, all of the switches $L_1$ through $L_n$ are turned off.

Also in the display driver of this embodiment, since the first current-input MOSFET 10, the mirroring device group 9 and the second current-input MOSFET 12 are placed in a longitudinal direction of the display driver LSI in accordance with the placement of output terminals, certain diffusion conditions during LSI formation may allow their threshold values Vt to vary.

However, according to the display driver of this embodiment, currents each having an equal magnitude are fed not only from the first mirroring device $CM_1$ end but also from the n-th mirroring device $CM_n$ end. Thus, as compared with the known display driver, variations in current produced by each of the MOSFETs constituting the mirroring device group 9 can be reduced to be small.

The reason for this is as follows.

Typically, in one semiconductor chip, the degree of diffusion of impurities varies from one end to the other end with inclination. To be specific, for example, the MOSFETs constituting a mirroring device group have gradually increased (or decreased) threshold values from the first mirroring device $CM_1$ toward the n-th mirroring device $CM_n$. With this configuration, assuming that gate voltages Vgs of the MOSFETs constituting the mirroring device group 9 are all equal, the current flowing through a MOSFET having a high threshold value becomes relatively small so that values of currents flowing through the mirroring devices vary. Consequently, in the known display driver, the currents produced by the current mirrors located in the LSI vary and deviate from a theoretical value.

On the other hand, the display driver of this embodiment has a structure in which equal currents are delivered from both ends of the mirroring device group 9 that are considered to vary most greatly in their threshold values. For example, if the threshold value of the second current-input MOSFET 12 is higher than that of the first current-input MOSFET 10, a current that is substantially equal to the current flowing through the first current-input MOSFET 10 flows through the second current-input MOSFET 12. Thus, the gate voltage Vgs applied to the second current-input MOSFET 12 becomes higher than the gate voltage Vgs applied to the first current-input MOSFET 10. Therefore, the gate voltages Vgs applied to the gate electrodes of the first current-input MOSFET 10, the first mirroring device $CM_1$, the second mirroring device $CM_2$, and the n-th mirroring device $CM_n$ have an inclination inside the LSI. As a result, the inclination of the gate voltages Vgs compensates for variations in the threshold values so that more uniform current distribution can be produced by the mirroring devices inside the display driver LSI.

Since in this way currents produced by the mirroring devices located in the mirroring device group 9 can become substantially uniform, output currents of D/A converters can become substantially uniform. In this manner, variations in output voltages from drive voltage supply units located in the same LSI can be reduced. Therefore, the use of the display driver of this embodiment enables variations in brightness of the display panel to be reduced with a high degree of efficiency.

In particular, the display driver of this embodiment is useful when the display driver LSI has a length exceeding 10 mm along the longitudinal direction of the LSI chip. In this case, the display driver of this embodiment can preferably be used for a large-screen or high-definition liquid crystal display or the like.

In the display driver of this embodiment, it is preferable that the second and third MOSFETs 19 and 21 serving as current sources for feeding equal currents are placed close to each other as described above. Furthermore, the second and third MOSFETs 19 and 21 are preferably placed in the vicinity of the central portion of the display driver LSI in which variations in diffusion of impurities are smallest. In order to supply equal reference currents to the first current-input MOSFET 10 and the second current-input MOSFET 12, it is desirable that a wire via which the second MOSFET 19 is connected to the first current-input MOSFET 10 has the same length and width as a wire via which the third MOSFET 21 is connected to the second current-input MOSFET 12. In addition, it is preferable that the first MOSFET 18 is also placed close to the second MOSFET 19 and the third MOSFET 21.

A MOSFET constituting a current mirror in conjunction with the second MOSFET 19 and the third MOSFET 21 can be further provided between them to serve as a third current source of the mirroring device group 9. In this case, a current-input MOSFET for receiving a reference current $I_1$ from the third current source is placed in the central portion of the mirroring device group 9. In this manner, the currents produced by the mirroring devices of the drive voltage supply unit can be further equalized.

Although each of the first and second current-input MOSFETs 10 and 12 shown in FIGS. 1 and 2 is shown as a single MOSFET, use can be made instead of a current mirror circuit which is composed of plural MOSFETs connected in parallel to each other. The reference current $I_1$ is often set at a larger value than a current $I_2$ flowing through the mirroring device group 9. In this case, it is more preferable to use plural small MOSFETs than to use a single large MOSFET, because accuracy is enhanced.

Although the above describes an example in which a current mirror circuit having plural reference current sources is utilized for a voltage-driven display driver, a current-driven display, such as an organic electroluminescence (EL) panel, can be driven using the similar current mirror circuit. In this case, the current/voltage converter 20 is removed from the drive voltage supply unit shown in FIG. 2.

The display driver of this embodiment can also be operated using a bipolar transistor instead of the MOSFETs constituting the current mirror.

The display driver of this embodiment can be used not only for displays but also for printer heads.

(Embodiment 2)

Figure 3:
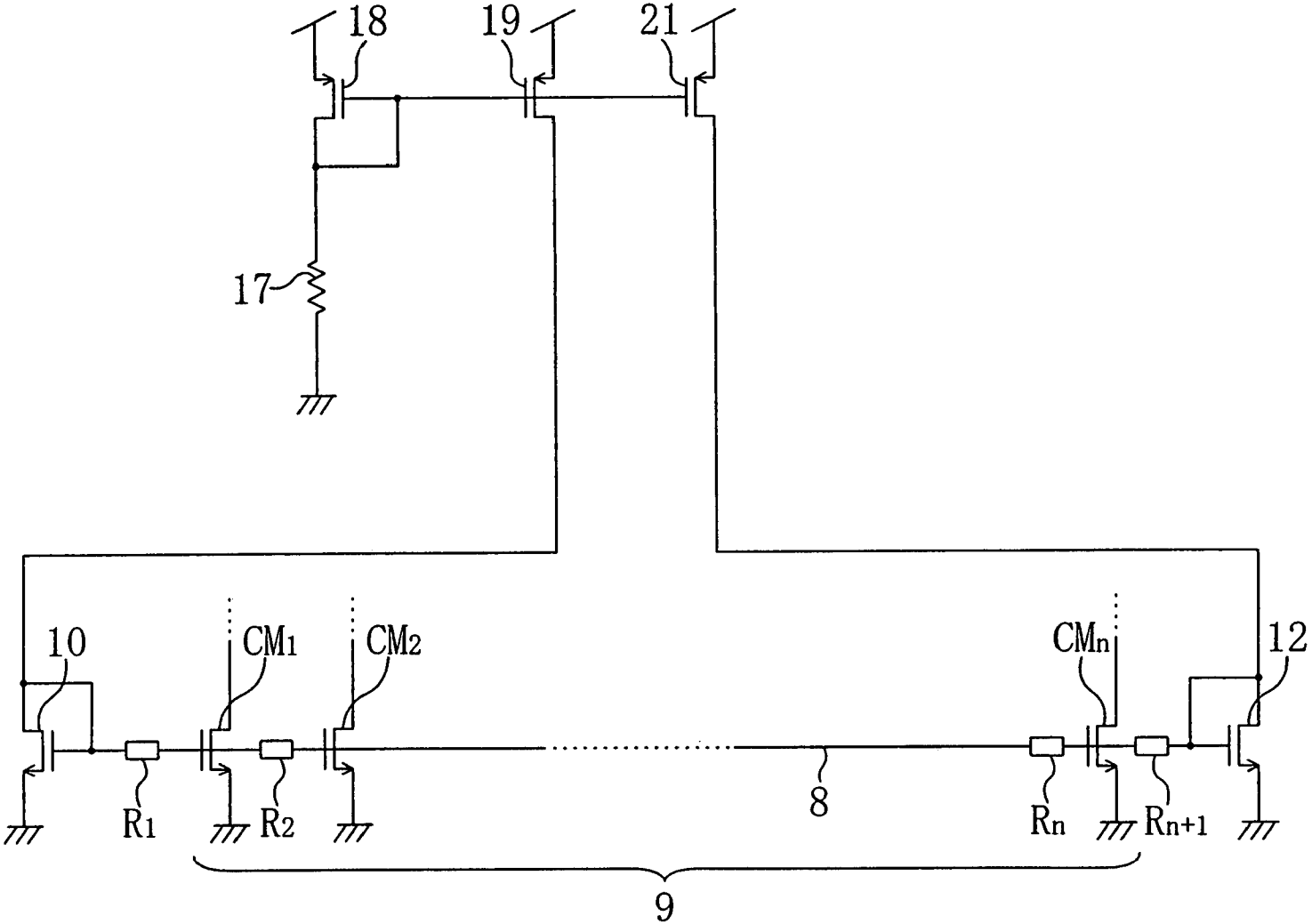
FIG. 3 is a circuit diagram showing a display driver according to a second embodiment of the present invention.

FIG. 3 is a circuit diagram showing a display driver according to a second embodiment of the present invention.

As shown in FIG. 3, the display driver of this embodiment is characterized by comprising resistors each having an equal resistance value between gate electrodes of each current-input MOSFET and an adjacent mirroring device and between the gate electrodes of each adjacent two of the mirroring devices. Since the other structures are the same as those of the first embodiment, a description will not be given.

As shown in FIG. 3, in the display driver of this embodiment, resistors $R_1, R_2, \ldots, R_n, R_{n+1}$ are provided, through a gate signal conductor 8 connecting the gate electrode of the first current-input MOSFET 10 to the gate electrode of the second current-input MOSFET 12, between the gate electrodes of the first current-input MOSFET 10 and the first mirroring device $CM_1$, between the gate electrodes of each adjacent two of mirroring devices and between the gate electrodes of a mirroring device $CM_n$ and the second current-input MOSFET 12, respectively. Each of the resistors $R_1, R_2, \ldots, R_n, R_{n+1}$ has a resistance value of approximately several kO through ten kO and is composed of, for example, polysilicon or a diffused resistor. The present inventors have prototyped a driver for a 528-output display in which each of the resistors has a resistance value of 2 kO (the whole resistance value is approximately 1 MO) and demonstrated the operation of the display driver.

On the other hand, the resistance value of the gate signal conductor 8 connecting the mirroring devices to one another in the LSI is totally about several O through a few hundred O when a metal material such as Al (aluminum) is used.

In the display driver of the first embodiment shown in FIG. 1, when the resistance of the gate signal conductor 8 is low, the gate voltages Vgs of the MOSFETs constituting the mirroring device group 9 in some cases become substantially uniform voltage values inside the LSI, and thus variations in the threshold values cannot be compensated for.

To cope with this, in the display driver of this embodiment, polysilicon resistors or diffused resistors each having a much higher resistance value than that of a metal wire are provided between gate electrodes of each adjacent two of the mirroring devices, resulting in a drop in the gate voltages of the mirroring devices. Therefore, even when the resistance value of the metal wire is low, variations in the threshold values of the mirroring devices can be compensated for using the display driver of this embodiment. Thus, variations in the output voltage of the drive voltage supply unit having the mirroring devices can be reduced using the display driver of this embodiment, thereby controlling the voltage-driven display without any variation in brightness.

In the display driver of this embodiment, the resistor between each adjacent two of the mirroring devices may have a wire itself fabricated from a high-resistance material such as polysilicon.

(Embodiment 3)

As a third embodiment of the present invention, a description will be given of an example in which plural chips of the display driver LSIs according to the second embodiment are connected to one another. Although in the following embodiments the term "display driver LSI" is used to represent display drivers provided on one chip, the scope of a circuit to be described therein is the same as in the first and second embodiments.

Figure 4:
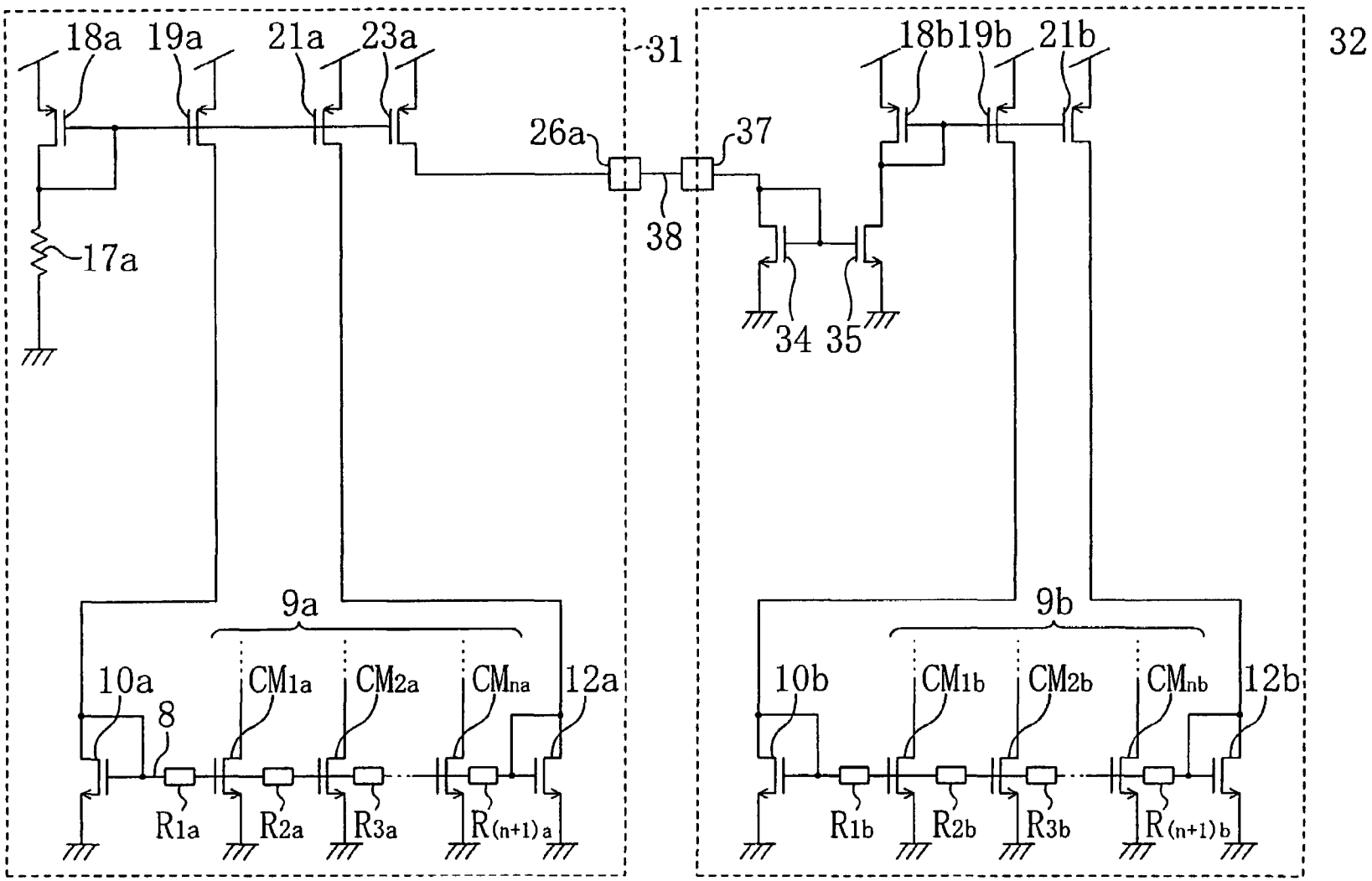
FIG. 4 is a circuit diagram showing the display driver LSIs according to the second embodiment which are connected to each other.

FIG. 4 is a circuit diagram showing the display driver LSIs according to the second embodiment that are connected to each other. In an example shown in FIG. 4, a chip on which a first display driver LSI 31 is provided is connected via a current transmission path 38 to a chip on which a second display driver LSI 32 is provided.

The first display driver LSI 31 comprises a first MOSFET 18*a*, a resistor 17*a* connected to the first MOSFET 18*a*, second, third and fourth MOSFETs 19*a*, 21*a* and 23*a* of a first conductive type (P-channel type) constituting a current mirror in conjunction with the first MOSFET 18*a* and serving as reference current sources, a first current-input MOSFET 10*a* connected to the second MOSFET 19*a*, a second current-input MOSFET 12*a* connected to the third MOSFET 21*a*, a mirroring device group 9*a* constituting a current mirror in conjunction with the first current-input MOSFET 10*a* and the second current-input MOSFET 12*a*, a gate signal conductor 8 connecting the gate electrode of the first current-input MOSFET 10*a* to that of the second current-input MOSFET 12*a*, resistors $R_{1a}$ through $R_{(n+1)n}$ connected through the gate signal conductor 8, and a current-transfer terminal 26*a* connected to the fourth MOSFET 23*a* for delivering a reference current to the adjacent second display driver LSI 32. That is, unlike the display driver of the second embodiment, the first display driver LSI 31 is provided with the fourth MOSFET 23*a* for distributing the reference current and the current-transfer terminal 26*a* such that the reference current can be transferred to the adjacent display driver LSI. The size of the fourth MOSFET 23*a* is equal to that of each of the second and third MOSFETs 19*a* and 21*a*. The fourth MOSFET 23*a* is preferably provided in the vicinity of the second and third MOSFETs 19*a* and 21*a* to have the same electrical characteristics as those of them. It is preferable that the distance between the third MOSFET 21*a* and the fourth MOSFET 23*a* is usually 100 μm or less.

The second display driver LSI 32 has substantially the same structure as the first display driver LSI 31. However, while a predetermined current is produced in the first display driver LSI 31 by the first MOSFET 18*a* and the resistor 17*a*, the reference current is transmitted in the second display driver LSI 32 by a first current-input/output terminal 37 connected to the current-transfer terminal 26*a*, a fifth MOSFET 34 of a second conductive type (N-channel type) having a gate electrode and a drain both connected to the first current-input/output terminal 37, a sixth MOSFET 35 constituting a current mirror in conjunction with the fifth MOSFET 34, and a seventh MOSFET 18*b* connected to the sixth MOSFET 35. Although FIG. 4 shows an example in which the second display driver LSI does not include a current-transfer terminal and a current mirror for transferring the reference current to the current-transfer terminal, they are provided when three or more display driver LSIs are connected to one another.

In the two display driver LSIs shown in FIG. 4, the fourth MOSFET 23*a* is equal in size to each of the second MOSFET 19*a* and the third MOSFET 21*a*. Therefore, the reference current is delivered from the third MOSFET 21*a*. Then, the reference current is fed via the current-transfer terminal 26*a* and the current transmission path 38 to the first current-input/output terminal 37. If the fifth MOSFET 34 and the sixth MOSFET 35 constituting a current mirror are equal in size ratio to each other, the reference current is transferred from the former to the latter and fed to the seventh MOSFET 18*b*. At this time, when the seventh MOSFET 18*b*, an eighth MOSFET 19*b* and a ninth MOSFET 21*b* are equal in size ratio to one another, the reference current is distributed to each of the eighth MOSFET 19*b* and the ninth MOSFET 21*b* and are then fed to the third current-input MOSFET 10*b* and the fourth current-input MOSFET 12*b* provided at both ends of a mirroring device group 9*b*, respectively. When the second display driver LSI 32 is provided with a current-transfer terminal and a current mirror for transferring the reference current to the current-transfer terminal, the reference current can be transferred to the adjacent display driver LSI likewise.

When the screen of a display is large, plural display driver LSI chips are provided. However, in many cases, the characteristics of transistors provided on different chips vary greatly as compared with those of transistors provided on the same chip. According to the display driver LSI of this embodiment, the reference current produced by the first display driver LSI can be transferred to both ends of the mirroring device group in each of the plural display driver LSIs. Thus, even when threshold values of the MOSFETs constituting mirroring device groups and located in the plural display driver LSIs vary, the substantially equal current can be delivered from each of the display driver LSIs. Therefore, as in this embodiment, the equal current is fed to each of the mirroring device groups located in the plural display driver LSIs, thereby driving a large-screen display panel without any variation in brightness.

Furthermore, unlike a known method in which a voltage is distributed to each of the plural display driver LSIs, a current is distributed in the display driver LSI of this embodiment. Therefore, the number of wires inside the chip can be reduced.

Although in this embodiment a description was given of an example in which plural display driver LSIs according to the second embodiment are connected to one another, display driver LSIs according to the first embodiment can be used instead.

(Embodiment 4)

As a fourth embodiment of the present invention, a description will be given of another example in which plural chips of the display driver LSIs according to the second embodiment are connected to one another.

Figure 5:
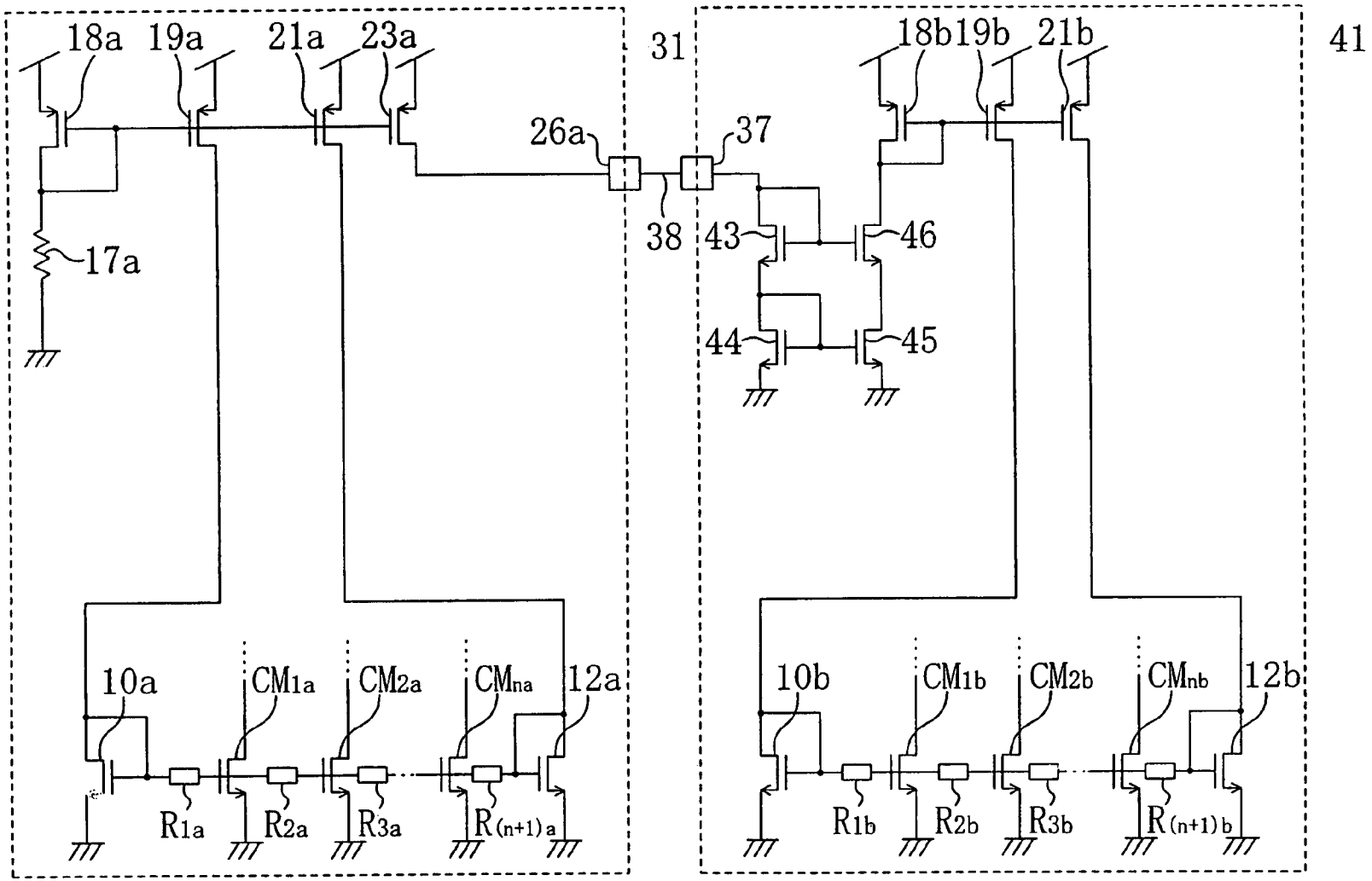
FIG. 5 is a circuit diagram showing another example of the display driver LSIs according to the second embodiment which are connected to each other.

FIG. 5 is a circuit diagram showing the display driver LSIs according to the second embodiment that are connected to each other. Unlike the display driver LSIs shown in FIG. 4, one of display driver LSIs shown in FIG. 5 is provided with a so-called cascode current mirror between a first current-input/output terminal 37 and a seventh MOSFET 18*b*. Since the other structures are the same as those of the third embodiment, a description is not given.

That is, a second display driver LSI 41 shown in FIG. 5 comprises a first current-input/output terminal 37, a tenth MOSFET 43 having a drain and a gate both connected to the first current-input/output terminal 37, an eleventh MOSFET 44 cascode-connected to the source of the tenth MOSFET 43 and having a grounded source, a twelfth MOSFET 46 constituting a current mirror in conjunction with the tenth MOSFET 43 and having a drain connected to the drain of the seventh MOSFET 18*b*, and a thirteenth MOSFET 45 cascode-connected to the source of the twelfth MOSFET 46 and constituting a current mirror in conjunction with the eleventh MOSFET 44. The tenth, eleventh, twelfth and thirteenth MOSFETs 43, 44, 46, and 45 are all of a second conductive type (N-channel type). They have the same W/L ratio.

With this structure, constant-current characteristics of a current mirror are improved so that the error caused in propagating the reference current can be reduced as compared with the case where the structure of the current mirror shown in FIG. 3 is employed. Thus, since the outputs from the MOSFETs constituting the mirroring device group become uniform, the output current from a digital/analog converter (D/A converter) including the mirroring device group can also become uniform. Therefore, if the display driver LSIs of this embodiment are employed, the uniformity of a display such as a liquid crystal panel can be further improved.

As a cascode current mirror that can be used for the display driver LSI of this embodiment, a Wilson current mirror or the like is given besides one shown in FIG. 5.

(Embodiment 5)

Since in the display driver LSIs according to the third and fourth embodiments the first display driver is distinct in structure from the second display driver, two kinds of display driver LSIs need be prepared.

Unlike these embodiments, the case where plural display driver LSIs can be connected to one another using only one kind of chips will be described in a fifth embodiment of the present invention.

Figure 6A:
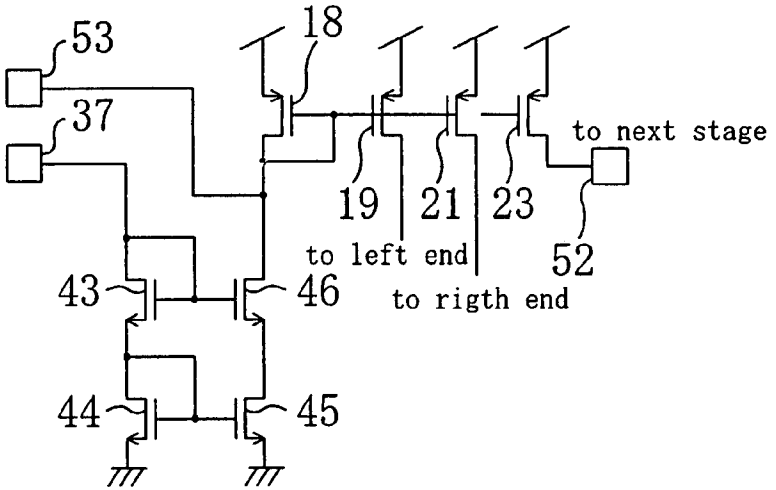
FIG. 6A is a circuit-diagram showing a display driver LSI according to a fifth embodiment of the present invention.
Figure 6B:
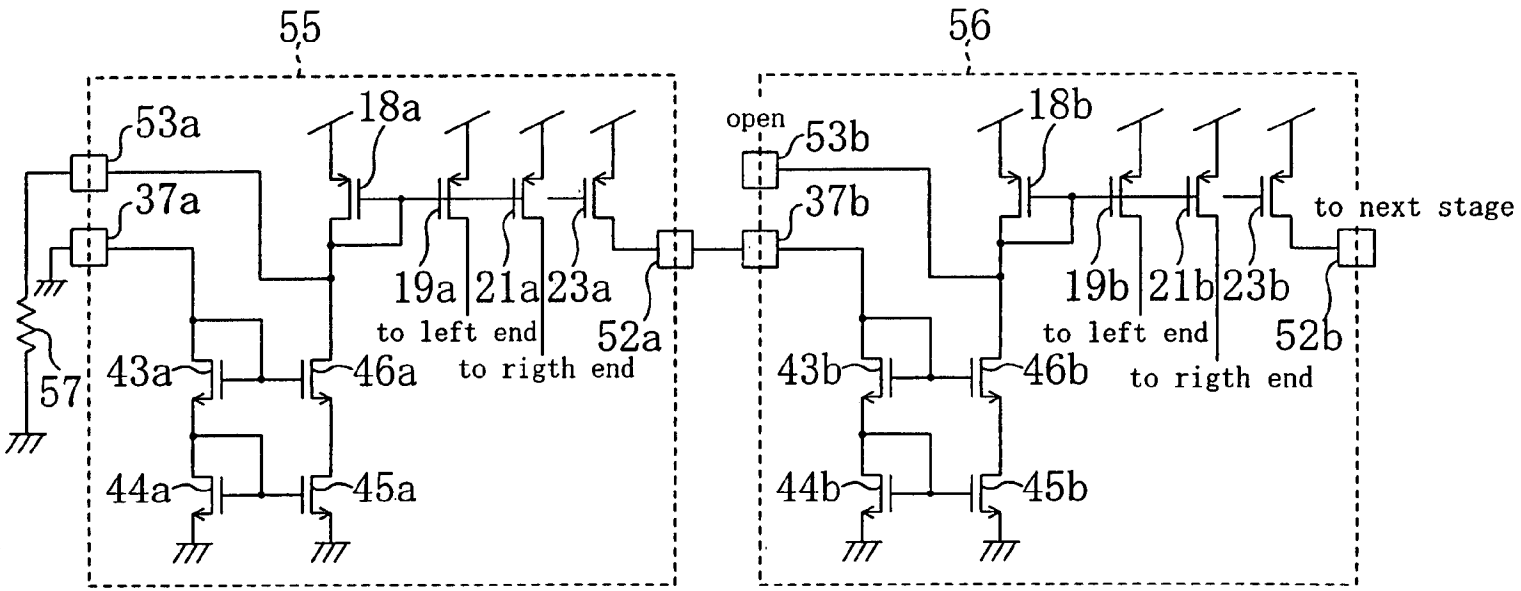
FIG. 6B is a circuit diagram showing an example in which a plurality of display driver LSIs are connected to one another.
Figure 7A:
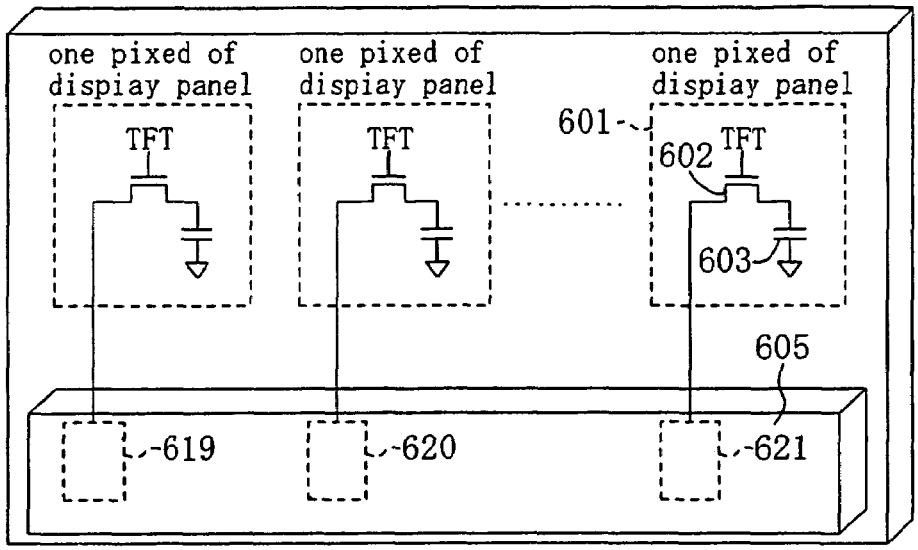
FIG. 7A PRIOR ART
FIG. 7A is a diagram schematically showing the structure of a display panel part of a liquid crystal display.
Figure 7B:
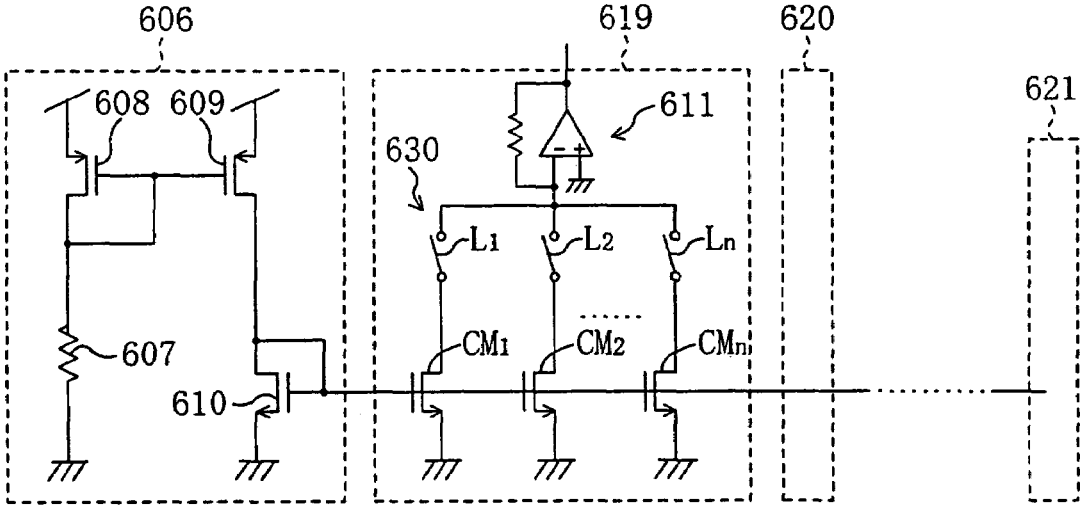
FIG. 7B PRIOR ART
FIG. 7B is a circuit diagram showing the structure of a known display driver.
Figure 7C:
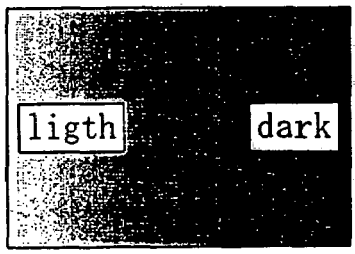
FIG. 7C PRIOR ART
FIG. 7C is a view showing variations in brightness of a display panel.

FIG. 6A is a circuit diagram showing a display driver LSI of this embodiment, and FIG. 6B is a circuit diagram showing an example in which a plurality of display driver LSIs of this embodiment are connected to one another. In these figures, a drive voltage supply unit including a mirroring device group is not shown, and the same numerals are given to the same members as in FIG. 5.

As shown in FIG. 6A, the display driver LSI of this embodiment has such a structure that the first display driver LSI 31 and the second display driver LSI 41 both shown in FIG. 5 are integrated. That is, unlike the second display driver LSI 41, the display driver LSI of this embodiment further comprises a second current-input/output terminal 53 connected to the drain of a first MOSFET 18 (the seventh MOSFET 18*b* in FIG. 5) and the drain of a twelfth MOSFET 46, a fourth MOSFET 23, and a current-transfer terminal 52 which is connected to the drain of the fourth MOSFET 23 and via which this display driver LSI is connected to a display driver located in the next stage.

With this structure, the plural display driver LSIs of this embodiment can be connected to one another as follows.

As shown in FIG. 6B, a resistor 57 provided outside a chip and grounded at one end is connected to a second current-input/output terminal 53*a* of a first display driver LSI 55 for producing a reference current. The first current-input/output terminal 37*a* is grounded.

If the first display driver LSI 55 is connected to the outside in this manner, the reference current is produced by the first MOSFET 18*a* and the resistor 57. At this time, both the gate electrodes of a tenth MOSFET 43*a* and a twelfth MOSFET 46*a* in a cascode current mirror are grounded. Therefore, no current flows through a tenth MOSFET 43*a*, an eleventh MOSFET 44*a*, a twelfth MOSFET 46*a*, and the thirteenth MOSFET 45*a*.

As shown in FIG. 6B, a current-transfer terminal 52*a* of the first display driver LSI 55 is connected via a current transmission path to a first current-input/output terminal 37*b* of a second display driver LSI 56. A second current-input/output terminal 53*b* of the second display driver LSI 56 is in an open state.

If the display driver LSIs are connected to each other in this manner, the reference current fed to the first current-input/output terminal 37*b* is transferred via the cascode current mirror to the seventh MOSFET 18*b*. Then, the reference current is transferred from the fourth MOSFET 23*b* to the current-transfer terminal 52*b*, and the transferred reference current is delivered to a display driver LSI located in the next stage.

In the later stages, the other display driver LSIs are cascade-connected like the second display driver LSI. As a result, a substantially equal reference current is distributed to each of plural chips.

As described above, the use of display driver LSIs of this embodiment enables a display panel to be driven by only one kind of chips. This reduces production cost of the panel.

Although in this embodiment a structure in which a mirroring device group of the D/A converter is composed of N-channel type MOSFETs and current is drawn from the panel side has been assumed, the same effects can also be obtained using current-output type current mirrors composed of P-channel-type MOSFETs. Furthermore, although the display driver LSI of this embodiment has a structure in which the reference current delivered from the P-channel-type MOSFETs is fed by the N-channel-type MOSFETs, the same effects can also be obtained when a current delivered from a display driver LSI in the subsequent stage is limited to a fixed current by N-channel-type transistors located in its previous stage.

When plural display driver LSIs are cascade-connected to one another, a resistor having the same resistance value as the resistor 57 may be connected to a current-transfer terminal 52 of a display driver LSI located in the last stage.

Bipolar transistors can be used instead of the MOSFETs included in the display driver of this embodiment.

What is claimed is:

1. A display driver for driving a pixel comprising:

a first transistor of a first conductive type;

a first reference transistor of the first conductive type constituting a current mirror with the first transistor;

a second reference transistor of the first conductive type constituting a current mirror with the first transistor;

a first current transistor of a second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a plurality of mirroring transistors of the second conductive type, gate electrodes of the plurality of mirroring transistors electrically connected to each other and electrically connected to both a gate electrode of the first current transistor and a gate electrode of the second current transistor; and an output circuit electrically connected to the plurality of mirroring transistors and capable of driving a wire connected to the pixel in response to an input digital data.

2. The display driver of claim 1, wherein a distance between the first reference transistor and the second reference transistor is less than or equal to 100 μm.

3. The display driver of claim 1, wherein the plurality of mirroring transistors are placed between the first current transistor and the second current transistor with respect to one direction of the display driver.

4. The display driver of claim 1, wherein the plurality of mirroring transistors are divided into K groups, where K is a natural number greater than or equal to two, so that each group includes $2^{(N-1)}$ transistors and the number of which is different from one another, where N is a natural number and $1 \leqq N \leqq K$, wherein the output circuit including:

K switches each electrically connected to an output of one of the K groups at one terminal and turned on or off in response to the input digital data; and a current-voltage converter electrically connected to the other terminal of each of the K switches, the current-voltage converter capable of driving the wire connected to the pixel.

5. The display driver of claim 1, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

6. The display driver of claim 1, further comprising:

a third reference transistor of the first conductive type constituting a current mirror with the first transistor; and a terminal electrically connected to the third reference transistor and transmitting a reference current from the third reference transistor to outside or from outside to the third reference transistor.

7. The display driver of claim 6, wherein a distance between the second reference transistor and the third reference transistor is less than or equal to 100 μm.

8. The display driver of claim 6, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

9. The display driver of claim 1, further comprising:

a second transistor of the second conductive type electrically connected to the first transistor and receiving a reference current from the first transistor or supplying a reference current to the first transistor;

a third transistor of the second conductive type constituting a current mirror with the second transistor; and a terminal electrically connected to the third transistor and transmitting a reference current from the third transistor to outside or from outside to the third transistor.

10. The display driver of claim 9, further comprising:

a fourth transistor of the second conductive type electrically connected to the second transistor and receiving a reference current from the second transistor or supplying a reference current to the second transistor; and a fifth transistor of the second conductive type constituting a current mirror with the fourth transistor and receiving a reference current from the third transistor or supplying a reference current to the third transistor.

11. The display driver of claim 10, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

12. A display driver for driving a pixel comprising:

a first transistor of a first conductive type;

a second transistor of a second conductive type electrically connected to the first transistor and receiving a reference current from the first transistor or supplying a reference current to the first transistor;

a third transistor of the second conductive type constituting a current mirror with the second transistor;

a first reference transistor of the first conductive type constituting a current mirror with the first transistor;

a second reference transistor of the first conductive type constituting a current mirror with the first transistor;

a third reference transistor of the first conductive type constituting a current mirror with the first transistor;

a first current transistor of the second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a plurality of mirroring transistors of the second conductive type, gate electrodes of the plurality of mirroring transistors electrically connected to each other and electrically connected to both a gate electrode of the first current transistor and a gate electrode of the second current transistor;

an output circuit electrically connected to the plurality of mirroring transistors and capable of driving a wire connected to the pixel in response to an input digital data;

a first terminal electrically connected to the third reference transistor and transmitting a reference current from the third reference transistor to outside or from outside to the third reference transistor;

a second terminal electrically connected to the third transistor and transmitting a reference current from the third transistor to outside or from outside to the third transistor; and a third terminal electrically connected to an intermediate node between the first transistor and the second transistor.

13. The display driver of claim 12, further comprising:

a fourth transistor of the second conductive type electrically connected to the second transistor and receiving a reference current from the second transistor or supplying a reference current to the second transistor; and a fifth transistor of the second conductive type constituting a current mirror with the fourth transistor and receiving a reference current from the third transistor or supplying a reference current to the third transistor.

14. The display driver of claim 13, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

15. A display driving system for driving pixels comprising:

a first display driver including:

a first transistor of a first conductive type;

a first reference transistor of the first conductive type constituting a current mirror with the first transistor;

a second reference transistor of the first conductive type constituting a current mirror with the first transistor;

a third reference transistor of the first conductive type constituting a current mirror with the first transistor;

a first terminal electrically connected to the third reference transistor and transmitting a reference current from the third reference transistor to outside or from outside to the third reference transistor;

a first current transistor of a second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a first plurality of mirroring transistors of the second conductive type, gate electrodes of the plurality of mirroring transistors electrically connected to each other and electrically connected to both a gate electrode of the first current transistor and a gate electrode of the second current transistor; and a first output circuit electrically connected to the plurality of mirroring transistors and capable of driving a wire connected to a pixel in response to an input digital data;

a second display driver including:

a second transistor of the first conductive type;

a third transistor of the second conductive type electrically connected to the second transistor and receiving a reference current from the second transistor or supplying a reference current to the second transistor;

a fourth transistor of the second conductive type constituting a current mirror with the third transistor;

a second terminal electrically connected to the fourth transistor and transmitting a reference current from the fourth transistor to outside or from outside to the fourth transistor;

a fourth reference transistor of the first conductive type constituting a current mirror with the second transistor;

a fifth reference transistor of the first conductive type constituting a current mirror with the second transistor;

a third current transistor of the second conductive type electrically connected to the fourth reference transistor and receiving a reference current from the fourth reference transistor or supplying a reference current to the fourth reference transistor;

a fourth current transistor of the second conductive type electrically connected to the fifth reference transistor and receiving a reference current from the fifth reference transistor or supplying a reference current to the fifth reference transistor;

a second plurality of mirroring transistors of the second conductive type, gate electrodes of the second plurality of mirroring transistors electrically connected to each other and electrically connected to both a gate electrode of the third current transistor and a gate electrode of the fourth current transistor; and a second output circuit electrically connected to the second plurality of mirroring transistors and capable of driving a wire connected to a pixel in response to an input digital data; and an electric wire electrically connecting the first terminal of the first display driver to the second terminal of the second display driver.

16. The display driving system of claim 15, wherein the second display driver further including:

a fifth transistor of the second conductive type electrically connected to the third transistor and receiving a reference current from the third transistor or supplying a reference current to the third transistor; and a sixth transistor of the second conductive type constituting a current mirror with the fifth transistor and receiving a reference current from the fourth transistor or supplying a reference current to the fourth transistor.

17. The display driving system of claim 16, wherein both the first display driver further includes a plurality of resistor elements each placed between the gate electrodes of the first plurality of mirroring transistors and between a gate electrode of one of the plurality of mirroring transistors and the gate electrode of the first current transistor and between a gate electrode of another one of the plurality of mirroring transistors and the gate electrode of the second current transistor and the second display driver further includes a plurality of resistor elements each placed between the gate electrodes of the second plurality of mirroring transistors and between a gate electrode of one of the second plurality of mirroring transistors and the gate electrode of the third current transistor and between a gate electrode of another one of the second plurality of mirroring transistors and the gate electrodes of the fourth current transistor.

18. A display driving system for driving pixels comprising:

a plurality of display drivers each including:

a first transistor of a first conductive type;

a second transistor of a second conductive type electrically connected to the first transistor and receiving a reference current from the first transistor or supplying a reference current to the first transistor;

a third transistor of the second conductive type constituting a current mirror with the second transistor;

a first reference transistor of the first conductive type constituting a current mirror with the first transistor;

a second reference transistor of the first conductive type constituting a current mirror with the first transistor;

a third reference transistor of the first conductive type constituting a current mirror with the first transistor;

a first current transistor of the second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a plurality of mirroring transistors of the second conductive type, gate electrodes of the plurality of mirroring transistors electrically connected to each other and electrically connected to both a gate electrode of the first current transistor and a gate electrode of the second current transistor;

an output circuit electrically connected to the plurality of mirroring transistors and capable of driving a wire connected to the pixel in response to an input digital data;

a first terminal electrically connected to the third reference transistor and transmitting a reference current from the third reference transistor to outside or from outside to the third reference transistor;

a second terminal electrically connected to the third transistor and transmitting a reference current from the third transistor to outside or from outside to the third transistor;

a third terminal electrically connected to an intermediate node between the first transistor and the second transistor, and electric wires electrically connecting two adjacent ones of the plurality display drivers, each electric wire electrically connecting the first terminal of one of the plurality of display drivers to the second terminal of the adjacent one of the plurality of display drivers, wherein the second terminal and the third terminal of a display driver at one end of the plurality of display drivers are electrically fixed at a certain voltage level, and wherein the first terminal and the third terminal of a display driver at another end of the plurality of display drivers are open.

19. The display driving system of claim 18, wherein each of the plurality of display drivers further including:

a fourth transistor of the second conductive type electrically connected to the second transistor and receiving a reference current from the second transistor or supplying a reference current to the second transistor; and a fifth transistor of the second conductive type constituting a current mirror with the fourth transistor and receiving a reference current from the third transistor or supplying a reference current to the third transistor.

20. The display driving system of claim 19, wherein each of the plurality of display drivers further including:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

21. A display driver for driving a pixel comprising:

a first reference transistor of a first conductive type;

a second reference transistor of the first conductive type having a gate electrode electrically connected to a gate electrode of the first reference transistor;

a first current transistor of a second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a plurality of mirroring transistors of the second conductive type between the first current transistor and the second current transistor, gate electrodes of the plurality of mirroring transistors electrically connected to each other and electrically connected to both a gate electrode of the first current transistor and a gate electrode of the second current transistor; and an output circuit electrically connected to the plurality of mirroring transistors and capable of driving a wire connected to the pixel in response to an input digital data.

22. The display driver of claim 21, wherein a distance between the first reference transistor and the second reference transistor is less than or equal to 100 um.

23. The display driver of claim 21, wherein the plurality of mirroring transistors are placed in a region between the first current transistor and the second current transistor.

24. The display driver of claim 21, wherein the plurality of mirroring transistors are placed in a region extending between the first current transistor and the second current transistor.

25. The display driver of claim 21, wherein the plurality of mirroring transistors are divided into K groups, where K is a natural number greater than or equal to two, so that each group includes $2^{(n-1)}$ transistors and the number of which is different from one another, where N is a natural number and $1 \leqq N \leqq K$, wherein the output circuit includes:

K switches each electrically connected to an output of one of the K groups at one terminal and turned on or off in response to the input digital data; and a current-voltage converter electrically connected to the other terminal of each of the K switches, the current-voltage converter capable of driving the wire connected to the pixel.

26. The display driver of claim 21, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

27. The display driver of claim 21, further comprising:

a third reference transistor of the first conductive type constituting a current mirror with the first transistor; and a terminal electrically connected to the third reference transistor and transmitting a reference current from the third reference transistor to outside or from outside to the third reference transistor.

28. The display driver of claim 27, wherein a distance between the second reference transistor and the third reference transistor is less than or equal to 100 um.

29. The display driver of claim 27, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

30. The display driver of claim 21, further comprising:

a first transistor of the first conductive type having a gate electrode electrically connected to the gate electrode of the first reference transistor;

a second transistor of the second conductive type electrically connected to the first transistor and receiving a reference current from the first transistor or supplying a reference current to the first transistor;

a third transistor of the second conductive type constituting a current mirror with the second transistor; and a terminal electrically connected to the third transistor and transmitting a reference current from the third transistor to outside or from outside to the third transistor.

31. The display driver of claim 30, further comprising:

a fourth transistor of the second conductive type electrically connected to the second transistor and receiving a reference current from the second transistor or supplying a reference current to the second transistor; and a fifth transistor of the second conductive type constituting a current mirror with the fourth transistor and receiving a reference current from the third transistor or supplying a reference current to the third transistor (Query)

32. The display driver of claim 31, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

33. A display driver for driving a pixel comprising:

a first transistor of a first conductive type;

a second transistor of a second conductive type electrically connected to the first transistor and receiving a reference current from the first transistor or supplying a reference current to the first transistor;

a third transistor of the second conductive type constituting a current mirror with the second transistor;

a first reference transistor of the first conductive type constituting a current mirror with the first transistor;

a second reference transistor of the first conductive type constituting a current mirror with the first transistor;

a third reference transistor of the first conductive type constituting a current mirror with the first transistor;

a first current transistor of the second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a plurality of mirroring transistors of the second conductive type between the first current transistor and the second current transistor, gate electrodes of the plurality of mirroring transistors electrically connected to each other and electrically connected to both a gate electrode of the first current transistor and a gate electrode of the second current transistor;

an output circuit electrically connected to the plurality of mirroring transistors and capable of driving a wire connected to the pixel in response to an input digital data;

a first terminal electrically connected to the third reference transistor and transmitting a reference current from the third reference transistor to outside or from outside to the third reference transistor;

a second terminal electrically connected to the third transistor and transmitting a reference current from the third transistor to outside or from outside to the third transistor; and a third terminal electrically connected to an intermediate node between the first transistor and the second transistor.

34. The display driver of claim 33, wherein the plurality of mirroring transistors are placed in a region between the first current transistor and the second current transistor.

35. The display driver of claim 33, wherein the plurality of mirroring transistors are placed in a region extending between the first current transistor and the second current transistor.

36. The display driver of claim 33, further comprising:

a fourth transistor of the second conductive type electrically connected to the second transistor and receiving a reference current from the second transistor or supplying a reference current to the second transistor; and a fifth transistor of the second conductive type constituting a current mirror with the fourth transistor and receiving a reference current from the third transistor or supplying a reference current to the third transistor.

37. The display driver of claim 36, further comprising:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

38. A display driving system for driving pixels comprising:

a first display driver including:

a first transistor of a first conductive type;

a first reference transistor of the first conductive type constituting a current mirror with the first transistor;

a second reference transistor of the first conductive type constituting a current mirror with the first transistor; a third reference transistor of the first conductive type constituting a current mirror with the first transistor;

a first terminal electrically connected to the third reference transistor and transmitting a reference current from the third reference transistor to outside or from outside to the third reference transistor;

a first current transistor of a second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a first plurality of mirroring transistors of the second conductive type between the first current transistor and the second current transistor, gate electrodes of the first plurality of mirroring transistors electrically connected to each other and electrically connected to both a gate electrode of the first current transistor and a gate electrode of the second current transistor; and a first output circuit electrically connected to the first plurality of mirroring transistors and capable of driving a wire connected to a pixel in response to an input digital data;

a second display driver including:

a second transistor of the first conductive type;

a third transistor of the second conductive type electrically connected to the second transistor and receiving a reference current from the second transistor or supplying a reference current to the second transistor;

a fourth transistor of the second conductive type constituting a current mirror with the third transistor;

a second terminal electrically connected to the fourth transistor and transmitting a reference current from the fourth transistor to outside or from outside to the fourth transistor;

a fourth reference transistor of the first conductive type constituting a current mirror with the second transistor;

a fifth reference transistor of the first conductive type constituting a current mirror with the second transistor;

a third current transistor of the second conductive type electrically connected to the fourth reference transistor and receiving a reference current from the fourth reference transistor or supplying a reference current to the fourth reference transistor;

a fourth current transistor of the second conductive type electrically connected to the fifth reference transistor and receiving a reference current from the fifth reference transistor or supplying a reference current to the fifth reference transistor;

a second plurality of mirroring transistors of the second conductive type between the third current transistor and the fourth current transistor, gate electrodes of the second plurality of mirroring transistors electrically connected to each other and electrically connected to both a gate electrode of the third current transistor and a gate electrode of the fourth current transistor; and a second output circuit electrically connected to the second plurality of mirroring transistors and capable of driving a wire connected to a pixel in response to an input digital data; and an electric wire electrically connecting the first terminal of the first display driver to the second terminal of the second display driver.

39. The display driver of claim 38, wherein the first plurality of mirroring transistors are placed in a region between the first current transistor and the second current transistor.

40. The display driver of claim 38, wherein the first plurality of mirroring transistors are placed in a region extending between the first current transistor and the second current transistor.

41. The display driver of claim 38, wherein the second plurality of mirroring transistors are placed in a region between the third current transistor and the fourth current transistor.

42. The display driver of claim 38, wherein the second plurality of mirroring transistors are placed in a region extending between the third current transistor and the fourth current transistor.

43. The display driving system of claim 38, wherein the second display driver further includes:

a fifth transistor of the second conductive type electrically connected to the third transistor and receiving a reference current from the third transistor or supplying a reference current to the third transistor; and a sixth transistor of the second conductive type constituting a current mirror with the fifth transistor and receiving a reference current from the fourth transistor or supplying a reference current to the fourth transistor.

44. The display driving system of claim 43, wherein the first display driver further includes:

a plurality of resistor elements each placed between the gate electrodes of the first plurality of mirroring transistors and between a gate electrode of one of the first plurality of mirroring transistors and the gate electrode of the first current transistor and between a gate electrode of another one of the first plurality of mirroring transistors and the gate electrode of the second current transistor.

45. The display driving system of claim 43, wherein the second display driver further includes:

a plurality of resistor elements each placed between the gate electrodes of the second plurality of mirroring transistors and between a gate electrode of one of the second plurality of mirroring transistors and the gate electrode of the third current transistor and between a gate electrode of another one of the second plurality of mirroring transistors and the gate electrode of the fourth current transistor, (Query)

46. A display driving system for driving pixels comprising:

a plurality of display drivers each including:

a first transistor of a first conductive type;

a second transistor of a second conductive type electrically connected to the first transistor and receiving a reference current from the first transistor or supplying a reference current to the first transistor;

a third transistor of the second conductive type constituting a current mirror with the second transistor;

a first reference transistor of the first conductive type constituting a current mirror with the first transistor;

a second reference transistor of the first conductive type constituting a current mirror with the first transistor;

a third reference transistor of the first conductive type constituting a current mirror with the first transistor;

a first current transistor of the second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a plurality of mirroring transistors of the second conductive type between the first current transistor and the second current transistor, gate electrodes of the plurality of mirroring transistors electrically connected to each other and electrically connected to both a gate electrode of the first current transistor and a gate electrode of the second current transistor;

an output circuit electrically connected to the plurality of mirroring transistors and capable of driving a wire connected to the pixel in response to an input digital data;

a first terminal electrically connected to the third reference transistor and transmitting a reference current from the third reference transistor to outside or from outside to the third reference transistor;

a second terminal electrically connected to the third transistor and transmitting a reference current from the third transistor to outside or from outside to the third transistor;

a third terminal electrically connected to an intermediate node between the first transistor and the second transistor, and electric wires electrically connecting two adjacent ones of the plurality display drivers, each electric wire electrically connecting the first terminal of one of the plurality of display drivers to the second terminal of the adjacent one of the plurality of display drivers, wherein the second terminal and the third terminal of a display driver at one end of the plurality of display drivers are electrically fixed at a certain voltage level, and wherein the first terminal and the third terminal of a display driver at another end of the plurality of display drivers are open.

47. The display driver of claim 46, wherein the plurality of mirroring transistors in each of the plurality of display drivers are placed in a region between the first current transistor and the second current transistor.

48. The display driver of claim 46, wherein the plurality of mirroring transistors in each of the plurality of display drivers are placed in a region extending between the first current transistor and the second current transistor.

49. The display driving system of claim 46, wherein each of the plurality of display drivers further includes;

a fourth transistor of the second conductive type electrically connected to the second transistor and receiving a reference current from the second transistor or supplying a reference current to the second transistor; and a fifth transistor of the second conductive type constituting a current mirror with the fourth transistor and receiving a reference current from the third transistor or supplying a reference current to the third transistor.

50. The display driving system of claim 49, wherein each of the plurality of display drivers further includes:

a plurality of resistor elements each placed between the gate electrodes of the plurality of mirroring transistors and between a gate electrode of one of the plurality of mirroring transistors and the gate electrode of the first current transistor and between a gate electrode of another one of the plurality of mirroring transistors and the gate electrode of the second current transistor.

51. A display driver for driving a pixel comprising:

a first reference transistor of a first conductive type;

a second reference transistor of the first conductive type having a gate electrically connected to a gate electrode of the first reference transistor;

a third reference transistor of the first conductive type having a gate electrode electrically connected to the gate electrodes of the first reference transistor and the second reference transistor;

a first current transistor of a second conductive type electrically connected to the first reference transistor and receiving a reference current from the first reference transistor or supplying a reference current to the first reference transistor;

a second current transistor of the second conductive type electrically connected to the second reference transistor and receiving a reference current from the second reference transistor or supplying a reference current to the second reference transistor;

a third current transistor of the second conductive type electrically connected to the third reference transistor and receiving a reference current from the third reference transistor or supplying a reference current to the third reference transistor;

a first plurality of mirroring transistors of the second conductive type, between the first current transistor and the third current transistor, gate electrodes of the first plurality of mirroring transistors electrically connected to each other and electrically connected to both a gate electrode of the first current transistor and a gate electrode of the third current transistor;

a second plurality of mirroring transistors of the second conductive type between the second current transistor and the third current transistor, gate electrodes of the second plurality of mirroring transistors electrically connected to each other and electrically connected to each other and electrically connected to both a gate electrode of the second current transistor and the gate electrode of the third current transistor; and an output circuit electrically connected to the first and second plurality of mirroring transistors and capable of driving a wire connected to the pixel in response to an input digital data.

52. The display driver of claim 51, wherein the first plurality of mirroring transistors are placed in region between the first current transistor and the third current transistor.

53. The display driver of claim 51, wherein the first plurality of mirroring transistors are placed in region extending between the first current transistor and the third current transistor.

54. The display driver of claim 51, wherein the second plurality of mirroring transistors are placed in region between the second current transistor and the third current transistor.

55. The display driver of claim 51, wherein the second plurality of mirroring transistors are placed in region extending between the second current transistor and the third current transistor.

* * * * *